United States Patent [19]

Füssl

[11] 4,289,482

[45] Sep. 15, 1981

[54] FUEL LANCE STRUCTURE FOR A UNIFLOW REGENERATIVE SHAFT FURNACE

[75] Inventor: Erwin Füssl, Zürich, Switzerland

[73] Assignee: Maerz Ofenbau AG, Zürich, Switzerland

[21] Appl. No.: 78,765

[22] Filed: Sep. 25, 1979

[30] Foreign Application Priority Data

Feb. 28, 1979 [CH] Switzerland ..... 1963/79

[51] Int. Cl.[3] ..... F27D 1/08; F27B 15/00

[52] U.S. Cl. ..... 432/96; 432/14

[58] Field of Search ..... 432/14, 96

[56] References Cited

U.S. PATENT DOCUMENTS 1,243,311 10/1917 Loder ..... 432/96

3,771,946 11/1973 Hofer et al. ..... 432/14

FOREIGN PATENT DOCUMENTS 50-28920 9/1975 Japan ..... 432/96

*Primary Examiner*—John J. Camby

*Attorney, Agent, or Firm*—Toren, McGeady and Stanger

[57] ABSTRACT

Coking of liquid fuel supplied through a fuel lance in a calcining furnace is prevented by surrounding a fuel tube in the fuel lance with a tubular jacket forming an annular gap between the jacket and the fuel tube for supplying a cooling medium through the lance. The jacket may be additionally provided with insulation which can be protected from damage caused by downwardly traveling bulk material by the additional provision of a protective tube.

3 Claims, 3 Drawing Figures

FUEL LANCE STRUCTURE FOR A UNIFLOW REGENERATIVE SHAFT FURNACE

BACKGROUND OF THE INVENTION

The present invention relates to a uniflow regenerative shaft furnace for calcining limestone and similar mineral raw materials utilizing liquid fuels introduced by means of fuel lances suspended in the bulk material at the preheating zone of the furnace. The shaft furnace includes at least two shafts connected in flow communication through a transfer duct with the shafts being alternately operated one as the calcining or uniflow shaft and the other as the counterflow shaft.

A regenerative process for calcining mineral raw materials known from Austrian AT-PS 211,214 is frequently used for the construction of uniflow/counterflow shaft furnaces having at least two shafts. In uniflow regenerative shaft furnaces having at least two shafts, it is known to use gaseous and liquid fuels; see, for example, the magazine "Zement-Kalk-Gips" (cement-lime-Gypsum), no. 6, 1970, pages 217ff.

When furnaces utilizing this system were initially constructed, swivel burners were selected for supplying the liquid fuels. These swivel burners spray oil at a transition between a preheating zone and a calcining zone of the furnace beneath a burner bridge directly onto the bulk material to be calcined arranged in this location. Due to the fact that temperatures in the range of about 700° Celsius prevail at this location, the oil is vaporized very rapidly and it subsequently burns with combustion air which flows downwardly in the uniflow shaft of the furnace.

For furnaces utilizing this system which were heated by gas, for example, natural gas, vaporized liquified gas or light gasoline, coke-oven gas, mixed gas, etc, fuel lances made of steel tubes were used from the beginning, wherein the lances were directly suspended in the limestone bulk material of the preheating zone. For vaporized liquidified gases, insulated steel tubes have also been found suitable.

If it is attempted to use fuel lances which are suspended in the bulk material for the supply of liquid fuels, significant difficulties become unavoidable. Due to the temperatures prevailing in the fuel lances, cracking or coking of the oil occurrs which subsequently results in clogging of the fuel supply tube.

The present invention is directed toward development of a fuel lance structure for furnaces of the type described whereby use of liquid fuels is possible without creating problems in the preheating zone of the calcining shaft of the furnace.

SUMMARY OF THE INVENTION

In accordance with the invention, the fuel lances of the furnace are constructed to have the fuel tubes thereof, through which the fuel is supplied, surrounded by an annular gap with a flow of cooling medium being conveyed in the annular gap.

In the apparatus of the invention the fuel tube is surrounded by a tubular jacket, with an annular gap for supplying the cooling medium being formed between this tubular jacket and the fuel tube.

The various features of novelty which characterize the invention are pointed out with particularity in the claims annexed to and forming a part of this disclosure. For a better understanding of the invention, its operating advantages and specific objects attained by its use, reference should be had to the accompanying drawings and descriptive matter in which there are illustrated and described preferred embodiments of the invention.

DETAILED DESCRIPTION OF THE PREFERRED EMBODIMENTS

In order to enable use of fuel lances suspended in the bulk material for the supply of liquid fuels, the cracking or coking of the liquid fuel and the subsequent clogging of the fuel tubes must be prevented. This is achieved by means of fuel lances constructed in accordance with FIGS. 1 and 2.

Figure 3:
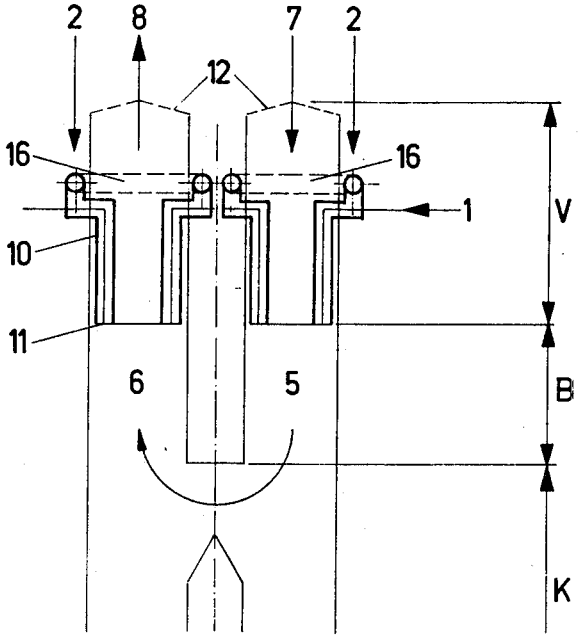
FIG. 3 is a schematic illustration of a uniflow regenerative shaft furnace having two shafts and fuel supply means embodying the fuel lances according to the invention.

Schematically illustrated in FIG. 3 is a uniflow regenerative shaft furnace having two shafts 5, 6 with fuel lances 10 arranged suspended in a preheating zone V of the two shafts 5, 6. Openings 11 of the fuel tubes or lances 10 are located at a transition area between the preheating zone V and a calcining zone B. The calcining zone B is located adjacent a cooling zone K.

In FIG. 3, the shaft 5 is operated as the uniflow or calcining shaft in which combustion air indicated by arrow 7 enters from above in the bulk material 12. The combustion gases which are generated by the combustion of the supplied fuel with the oxygen of the combustion air are transferred into the counterflow shaft 6. After having transferred their heat to the bulk material 12 they flow upwardly as exhaust gas indicated by arrow 8. In the uniflow calcining shaft 5, temperatures of about 700° Celsius prevail at the openings 11 of the fuel lances 10. Liquid fuels of the type contemplated for use in the furnace of FIG. 3 will tend to already experience coking at temperatures of about 300° to 350° Celsius. Such coking may be prevented or significantly reduced by means of fuel lances 10 constructed according to the present invention.

Figure 1:
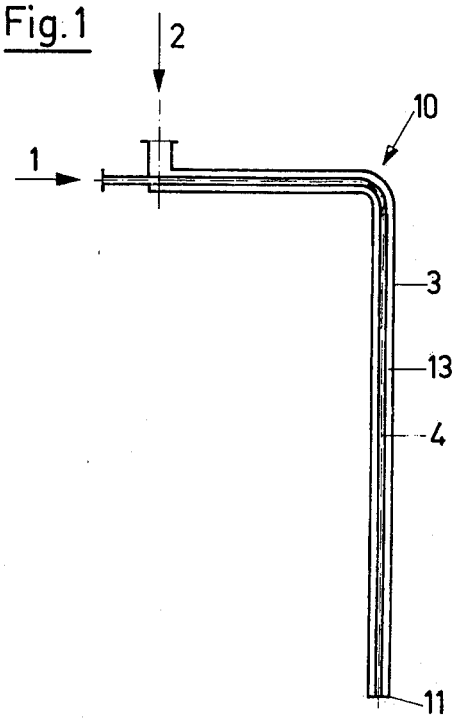
FIG. 1 is a sectional view through a first embodiment of a fuel lance in accordance with the invention.
Figure 2:
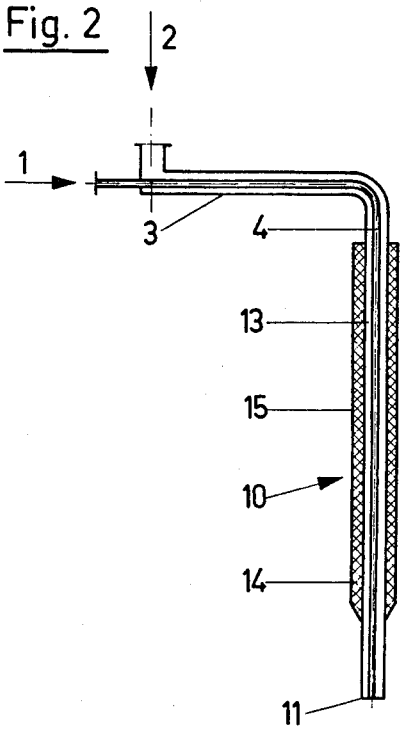
FIG. 2 is a sectional view through a second embodiment of a fuel lance according to the invention.

In FIGS. 1 and 2, the supply of the liquid fuel, including an atomizing medium, is indicated by arrow 1. The fuel 1 is conveyed to the lance opening 11 through a concentrically arranged fuel tube 4. The fuel tube 4 is usually a steel tube having an internal diameter of about 7 mm. During each combustion cycle, an amount of oil which is exactly predetermined by means of a dosing pump is supplied to each fuel lance 10 in the uniflow shaft 5.

Steam, compressed air or an inert gas can be used for atomizing the oil. To prevent the flue gases from entering the fuel lances 10 in the counterflow shaft, the atomizing medium is utilized as a flushing medium in this shaft.

In order to protect the relatively thin, central fuel tube 4 from downwardly travelling limestone bulk material 12, the fuel tube is covered by a tubular jacket or outer tube 3 which is preferably constructed as a steel tube. An annular gap 13 formed between the two tubes 3, 4 serves to convey a supply of a cooling medium, for example, air or inert gas, indicated by arrow 2 and serves the purpose of ensuring that the wall temperature of the fuel tube 4 will rise only to a maximum of 300° Celsius. For supplying the cooling medium, which may, for example, be cooling air, in amounts of 20 to 70 $m^3/h$ per fuel lance, a blower preferably of the rotary piston type is provided in each shaft, i.e. in the calcining shaft 5 and in the counterflow shaft 6. The blower should deliver a uniform amount of cooling air independently from the counter pressure at the lance openings 11.

The fuel lance shown in FIG. 2 is constructed similarly to the lance according to FIG. 1. The central fuel tube 4 serves for the supply of the fuel 1. Together with the tubular jacket 3, this fuel tube 4 forms an annular gap 13 through which the cooling medium 2 is supplied. Insulation 14 is placed around the tubular jacket 3 in the vertical portion of the fuel lance 10. No additional coating is required when the insulation 14 is a ceramic material. However, the insulation 14 may be surrounded by a protective tube 15 if there is danger that the insulation 14 will be damaged by downwardly traveling limestone bulk material.

FIG. 3 shows an arrangement of several fuel lances 10 in each shaft 5, 6. The combustion air 2 is supplied to the annular gap 13 of the individual fuel lances 10 through an annular line 16. The fuel 1 is supplied to each fuel lance 10 by means of a dosing pump.

While the fuel tube 4 has an external diameter of approximately 11 mm, the external diameter of the jacket tube 3 may be about 28–40 mm.

While specific embodiments of the invention have been shown and described in detail to illustrate the application of the inventive principles, it will be understood that the invention may be embodied otherwise without departing from such principles.

What is claimed is:

1. Apparatus for calcining limestone and similar raw materials comprising: a uniflow regenerative shaft furnace fired with liquid fuel and including a pair of uninsulated fuel lances suspended in bulk quantities of said raw materials through which said liquid fuel is supplied and at least two shafts connected in flow communication by transfer duct means alternately operating one as the calcining shaft of said furnace and the other as the counterflow shaft, said fuel lances being located at a preheating zone defined by said furnace; each of said fuel lances comprising a fuel tube forming a cylindrical line for said liquid fuel through which said liquid fuel flows and a tubular jacket surrounding said fuel tube and coaxial therewith forming together with said fuel tube an annular gap therebetween; said lances being situated, respectively, in a different one of said two shafts, with the lance situated in the uniflow shaft being supplied with fuel and cooling medium and with the lance situated in the counterflow shaft being supplied with cooling medium and flushing medium; each of said shafts being provided with a blower and each lance being provided with a dosing pump for supplying fuel.

2. Apparatus according to claim 1 wherein said liquid fuel is supplied to said fuel lances together with the addition of an atomizing medium.

3. Apparatus according to claim 1 wherein said blowers comprise a rotary piston blower.

* * * * *